US006994124B2

(12) United States Patent
Feng

(10) Patent No.: US 6,994,124 B2
(45) Date of Patent: Feb. 7, 2006

(54) THREE DIMENSIONAL WAFFLEWEAVE AND STITCHING METHOD THEREOF

(76) Inventor: Chen Feng, 21265 Corral Ct., Walnut, CA (US) 91789

( * ) Notice: Subject to any disclaimer, the term of this patent is extended or adjusted under 35 U.S.C. 154(b) by 205 days.

(21) Appl. No.: 10/762,741

(22) Filed: Jan. 23, 2004

(65) Prior Publication Data

US 2005/0164579 A1 Jul. 28, 2005

(51) Int. Cl.
*D03D 11/00* (2006.01)

(52) U.S. Cl. ..... 139/384 R; 139/383 R; 139/DIG. 1; 139/419; 139/408; 139/420 R; 139/426 R

(58) Field of Classification Search ..... 139/383 R, 139/384 R, 419, 408, 420 R, 426 R, DIG. 1
See application file for complete search history.

(56) References Cited

U.S. PATENT DOCUMENTS 2,511,500 A * 6/1950 Faris et al. ..... 139/384 R
3,006,057 A * 10/1961 Waite ..... 112/410
3,513,492 A * 5/1970 Phillips ..... 297/452.44
3,534,540 A * 10/1970 Demas et al. ..... 57/239
4,022,596 A * 5/1977 Pedersen ..... 55/528
4,229,953 A * 10/1980 Warsop ..... 66/193
4,929,398 A * 5/1990 Pedersen ..... 261/94
5,198,280 A * 3/1993 Harpell et al. ..... 428/102
5,567,087 A * 10/1996 Theisen ..... 405/302.7
5,616,399 A * 4/1997 Theisen ..... 428/175
6,432,138 B1 * 8/2002 Offray et al. ..... 623/8
6,745,531 B1 * 6/2004 Egan ..... 52/302.1
6,748,646 B2 * 6/2004 Von Arx et al. ..... 29/613

* cited by examiner

*Primary Examiner*—John J. Calvert
*Assistant Examiner*—Robert Muromoto
(74) *Attorney, Agent, or Firm*—Raymond Y. Chan; David & Raymond

(57) ABSTRACT

A three dimensional waffleweave includes a plurality of light coloring yarns interlaced with a plurality of dark coloring yarns to form a plurality of waffleweave units, wherein each of the waffleweave units, having an oblong shaped, defines four sidewalls and a center region within the four sidewalls. The center region of each of the waffleweave units is woven by the light coloring yarns and each of the sidewalls of each of the waffleweave units is woven by two dark coloring yarns while one of the dark coloring yarns is woven to float on the center region, such that a contrast of light and shade is created through the light coloring yarns and the dark coloring yarns to enhance a three dimensional stitching effect of the waffleweave.

15 Claims, 4 Drawing Sheets

THREE DIMENSIONAL WAFFLEWEAVE AND STITCHING METHOD THEREOF

BACKGROUND OF THE PRESENT INVENTION

1. Field of Invention

The present invention relates to a field of textiles, and more particularly to a three dimensional waffleweave and stitching method thereof, which provides a three dimensional stitching effect at each of the waffle units by knitting two different colors of yarns.

2. Description of Related Arts

Weaving has been known for many years. A typical plain weave pattern is constructed by a plurality of transverse yarns interlaced with a plurality of longitudinal yarns. Based on the basic weaving skill, thousands of weave patterns are made. One of the common weave patterns is waffle weave having a square or oblong-shaped box formation which appears on both the face and back sides of the fabric, by allowing both warp and weft yarns to float at fixed intervals.

Accordingly, the waffle weave pattern is formed by using a plurality of transverse yarns interlaced with a plurality of longitudinal yarns to form a plurality of waffle weave units. Each of the waffle weave units generally has an oblong shape defining four side walls and a ground area defined within the four side walls, wherein the yarns are respectively stitched at four side edges in a floating manner with respect to the ground area such that each of the waffle weave unit creates a three dimensional stitching effect on the fabric. However, such three dimensional stitching effect is not strong enough by only observation.

In order to enhance the three dimensional stitching effect, a thicker size of yarn can be used for substantially increasing the depth of the ground area because the height of each of the side walls are increased. However, the size of the yarn is substantially limited when the fabric is manufactured by a stitching machine. Thus, the cost of the fabric will be higher due to the thicker size of the yarn.

SUMMARY OF THE PRESENT INVENTION

A main object of the present invention is to provide a three dimensional waffleweave and stitching method thereof, which provides a three dimensional stitching effect at each of the waffle units by knitting two different colors of yarns.

Another object of the present invention is to provide a three dimensional waffleweave and stitching method thereof, wherein the two different colors of yarns are stitched to enhance the three dimensional stitching effect even by observation.

Another object of the present invention is to provide a three dimensional waffleweave and stitching method thereof, wherein the manufacturing process is as simple as the conventional process to provide the three dimensional stitching effect.

Another object of the present invention is to provide a three dimensional waffleweave and stitching method thereof, wherein no expensive or complicated structure is required to employ in the present invention in order to achieve the above mentioned objects. Therefore, the present invention successfully provides an economic and efficient solution not only for enhancing the three dimensional stitching effect of the waffleweave but also for simplifying the manufacturing process of three dimensional waffleweave to facilitate the practical use thereof.

Accordingly, in order to accomplish the above objects, the present invention provides a three dimensional waffleweave, comprising a plurality of light coloring yarns interlaced with a plurality of dark coloring yarns to form a plurality of waffleweave units, wherein each of the waffleweave units, having an oblong shape, defines four sidewalls and a center region within the four sidewalls. The center region of each of the waffleweave units is woven by the light coloring yarns and each of the sidewalls of each of the waffleweave units is woven by two dark coloring yarns while one of the dark coloring yarns is woven to float on the center region, such that a contrast of light and shade is created through the light coloring yarns and the dark coloring yarns to enhance a three dimensional stitching effect of the waffleweave.

The present invention further provides a method of stitching the three dimensional waffleweave, comprising the steps of:

(a) weaving a plurality of light coloring yarns;

(b) weaving a plurality of dark coloring yarns to interlace with the light coloring yarns to form a plurality of waffleweave units, wherein each of the waffleweave units, having an oblong shape, defines four sidewalls and a center region within the four sidewalls, wherein the center region of each of the waffleweave units is woven by the light coloring yarns and each of the sidewalls of each of the waffleweave units is woven by two dark coloring yarns; and (c) weaving one of the dark coloring yarns on the respective sidewall of each of the waffleweave units to float on the center region thereof, such that a contrast of light and shade is created through the light coloring yarns and the dark coloring yarns to enhance a three dimensional stitching effect of the waffleweave.

These and other objectives, features, and advantages of the present invention will become apparent from the following detailed description, the accompanying drawings, and the appended claims.

DETAILED DESCRIPTION OF THE PREFERRED EMBODIMENT

Figure 1:
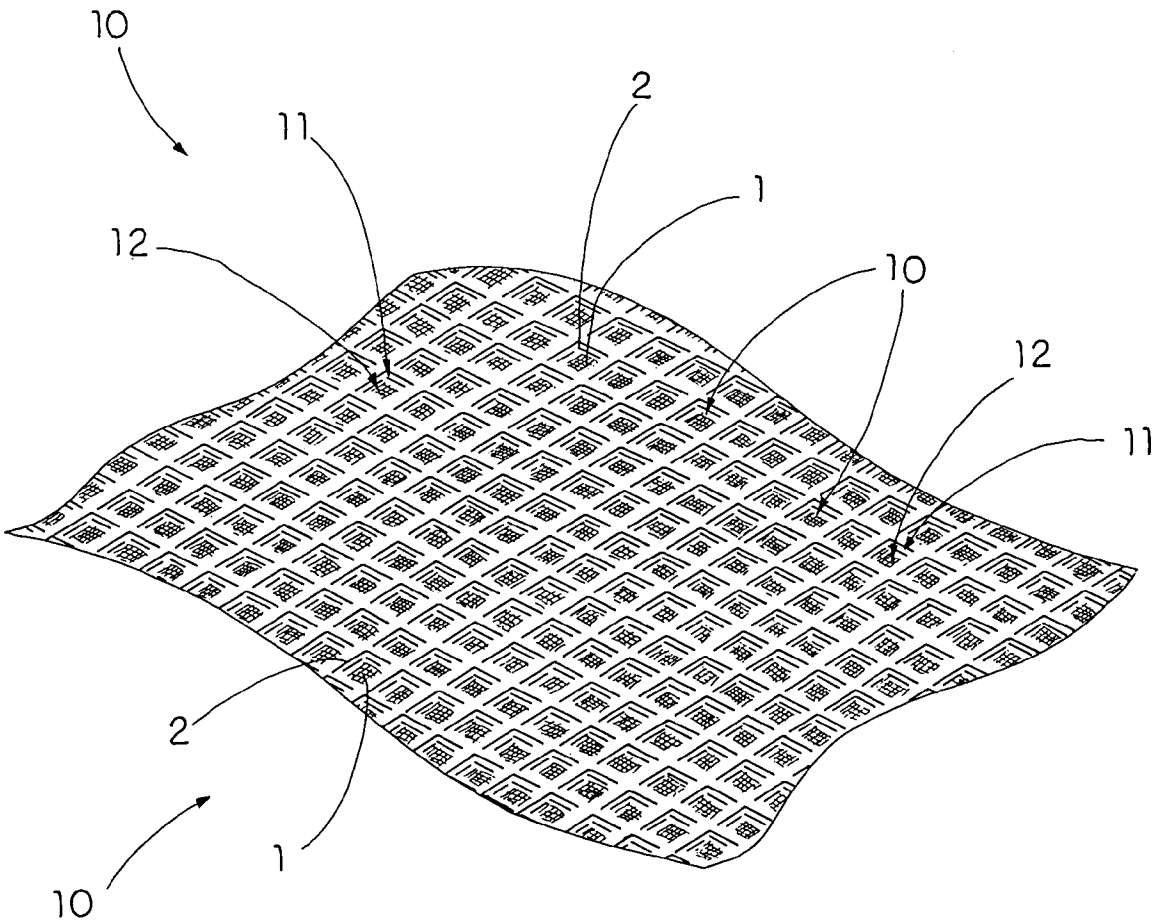
FIG. 1 is a perspective view of a three dimensional waffleweave according to a preferred embodiment of the present invention.
Figure 3:
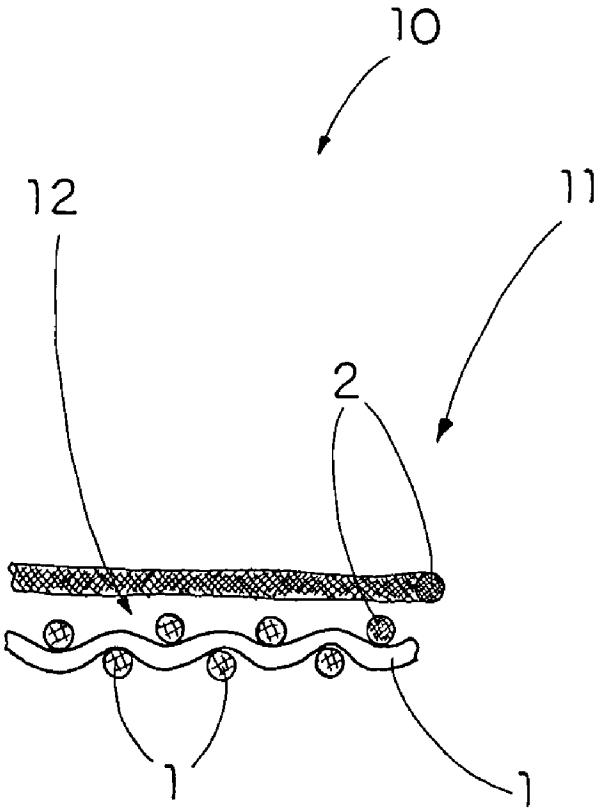
FIG. 3 is a sectional view of the three dimensional waffleweave according to the above preferred embodiment of the present invention.
Figure 4:
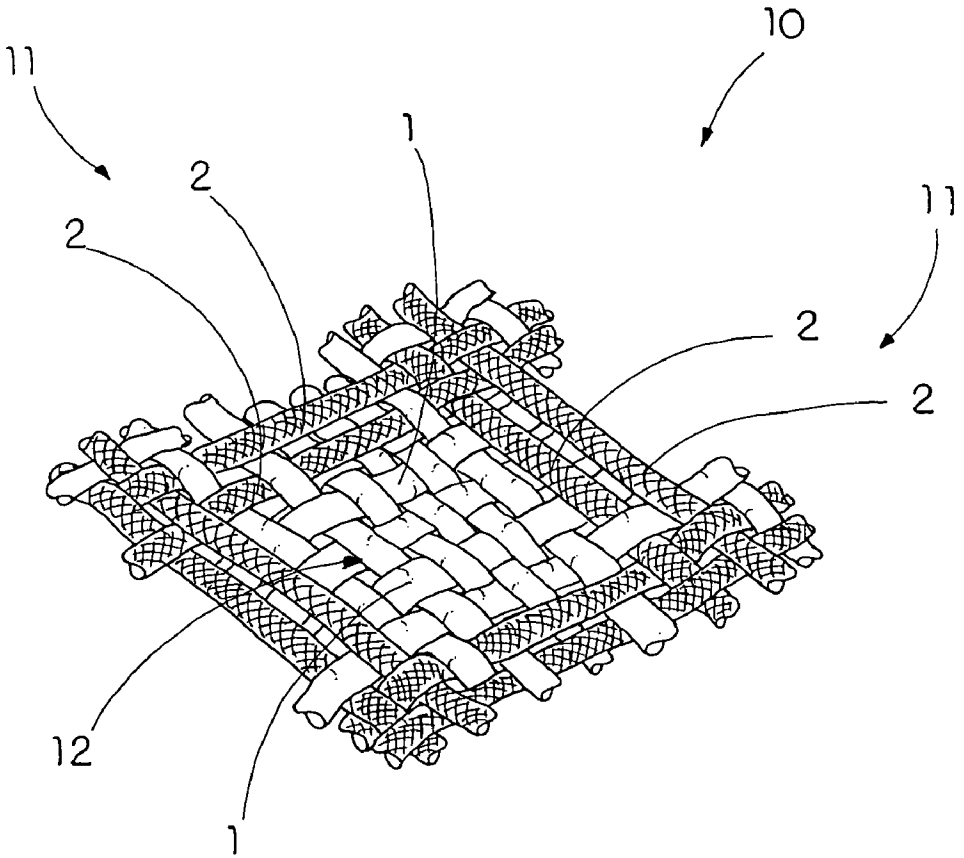
FIG. 4 is a perspective view of the waffleweave unit of the three dimensional waffleweave according to the above preferred embodiment of the present invention.

Referring to FIGS. 1, 3 and 4 of the drawings, a three dimensional waffleweave according to a preferred embodiment of the present invention is illustrated, wherein the three dimensional waffleweave comprises a plurality of light coloring yarns 1 interlaced with a plurality of dark coloring yarns 2 to form a plurality of waffleweave units 10.

Each of the waffleweave units 10, having an oblong shape, defines four sidewalls 11 and a center region 12 within the four sidewalls 12. The center region 12 of each of the waffleweave units 10 is woven by the light coloring yarns 1 and each of the sidewalls 11 of each of the waffleweave units 10 is woven by two dark coloring yarns 2 while one of the dark coloring yarns 2 is woven to float on the center region 12 as a shading yarn, such that a contrast of light and shade is created through the light coloring yarns 1 and the dark coloring yarns 2 to enhance a three dimensional stitching effect of the waffleweave, as shown in FIGS. 1 and 3.

Figure 2:
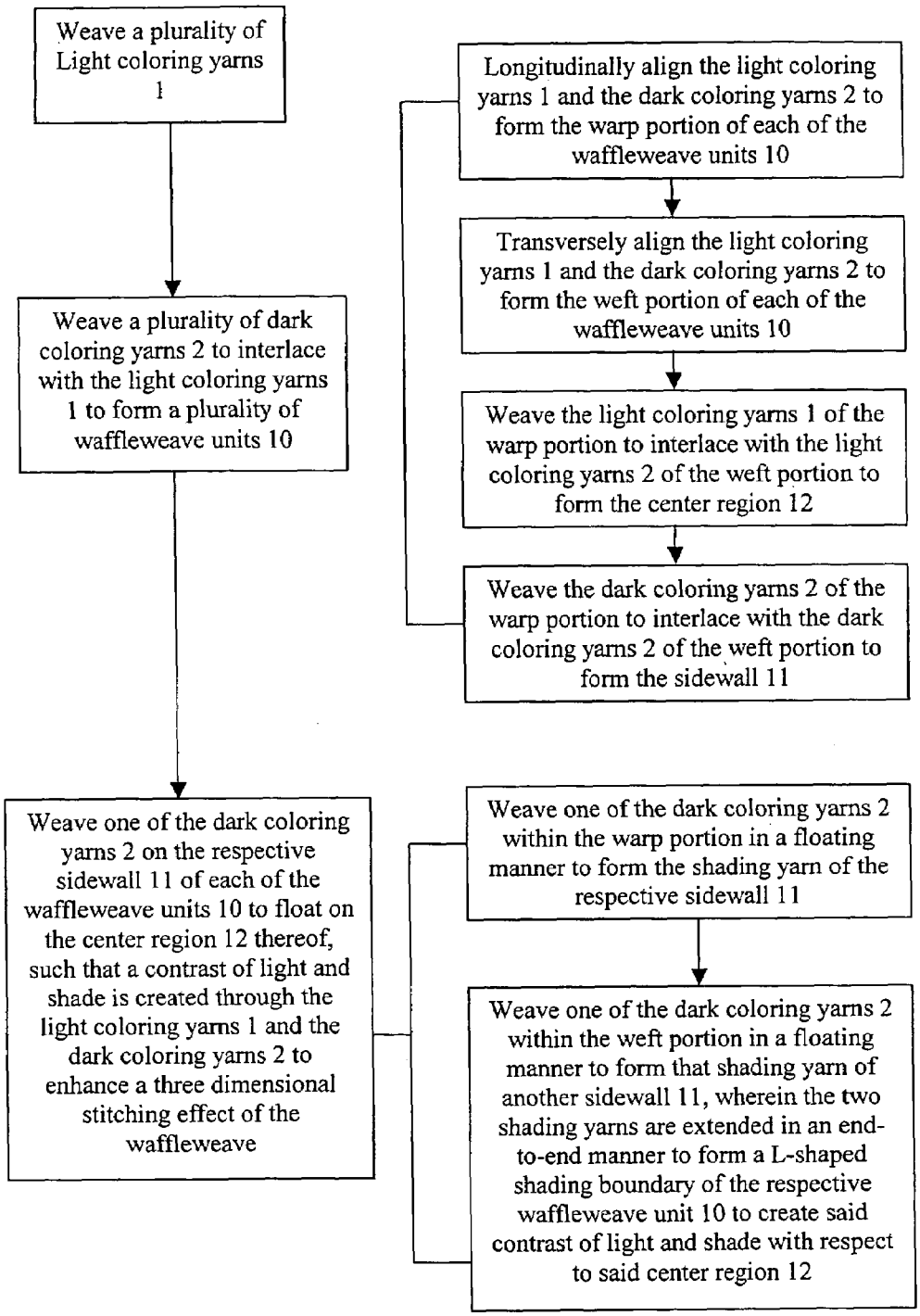
FIG. 2 is a flow diagram illustrating the method of stitching the three dimensional waffleweave according to the above preferred embodiment of the present invention.

As shown in FIG. 2, the present invention further comprises a method of stitching the three dimensional waffleweave which comprises the following steps.

(1) Weave a plurality of light coloring yarns 1.

(2) Weave a plurality of dark coloring yarns 2 to interlace with the light coloring yarns 1 to form a plurality of waffleweave units 10.

(3) Weave one of the dark coloring yarns 2 on the respective sidewall 11 of each of the waffleweave units 10 to float on the center region 12 thereof, such that a contrast of light and shade is created through the light coloring yarns 1 and the dark coloring yarns 2 to enhance a three dimensional stitching effect of the waffleweave.

According to the preferred embodiment, the two shading yarns of the two adjacent sidewalls 11 of each of said waffleweave units 10 are extended in an end-to-end manner to form a L-shaped shading boundary of the respective waffleweave unit 10 to create the contrast of light and shade with respect to the center region.

Preferably, the light coloring yarns 1 are in light grey color and the dark coloring yarns 2 are in black color in such a manner that when the light coloring yarns 1 are interlaced with the dark coloring yarns 2 to substantially create contrast of light and shade.

The light coloring yarns 1 and the dark coloring yarns 2 are longitudinally extending to form a warp portion of each of the waffleweave units 10 and the light coloring yarns 1 and the dark coloring yarns 2 are transversely extending to form a weft portion of each of the waffleweave units 10, wherein the light coloring yarns 1 of the warp portion are interlaced with the light coloring yarns 1 of the weft portion to form the center region 12, wherein the dark coloring yarns 2 of the warp portion are interlaced with the dark coloring yarns 2 of the weft portion to form the sidewalls 11. In other words, the warp yarn portion and the weft yarn portion are interlaced to form the center region 12 and the sidewalls 11 of each of the waffleweave units 10.

One of the dark coloring yarns 2 within the warp portion is woven in a floating manner to form the shading yarn of the respective sidewall 11 and one of the dark coloring yarns 2 within the weft portion is woven in a floating manner to form the shading yarn of another the sidewall 11, wherein the two shading yarns are extended in an end-to-end manner to form a L-shaped shading boundary of the respective waffleweave unit 10 to create the contrast of light and shade with respect to the center region 12, as shown in FIG. 4.

In step (2), the method of stitching the three dimensional waffleweave further comprises the following steps.

(2.1) Longitudinally align the light coloring yarns 1 and the dark coloring yarns 2 to form the warp portion of each of the waffleweave units 10.

(2.2) Transversely align the light coloring yarns 1 and the dark coloring yarns 2 to form the weft portion of each of the waffleweave units 10.

(2.3) Weave the light coloring yarns 1 of the warp portion to interlace with the light coloring yarns 2 of the weft portion to form the center region 12.

(2.4) Weave the dark coloring yarns 2 of the warp portion to interlace with the dark coloring yarns 2 of the weft portion to form the sidewalls 11.

The step (3) of the stitching method further comprises the following steps.

(3.1) Weave one of the dark coloring yarns 2 within the warp portion in a floating manner to form the shading yarn of the respective sidewall 11.

(3.2) Weave one of the dark coloring yarns 2 within the weft portion in a floating manner to form the shading yarn of another sidewall 11, wherein the two shading yarns are extended in an end-to-end manner to form a L-shaped shading boundary of the respective waffleweave unit 10 to create said contrast of light and shade with respect to said center region 12.

Accordingly, the warp yarn portion of each of the waffleweave units 10 is formed by six light coloring yarns 1 and two dark coloring yarns 2 extending longitudinally, wherein one of the two dark coloring yarns 2 is woven to float on the six light coloring yarns 1 as the shading yarn.

The weft yarn portion of each of the waffleweave units 10 is formed by four light coloring yarns 1 and two dark yarns 2 extending transversely wherein one of the two dark coloring yarns 2 is woven to float on the four light coloring yarns 1 as the shading yarn. In other words, totally eight warp yarns are interlaced with six weft yarns to form each of the waffleweave units 10.

In other words, the shading yarn in a longitudinal direction is intersected with the shading yarn in a transverse direction end to end to form the L-shaped shading boundary of the respective waffleweave unit 10.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A three dimensional waffleweave, comprising a plurality of light coloring yarns interlaced with a plurality of dark coloring yarns to form a plurality of waffleweave units, wherein each of said waffleweave units, having an oblong shape, defines four sidewalls and a center region within said four sidewalls, wherein said center region of each of said waffleweave units is woven by said light coloring yarns and each said sidewall of each of said waffleweave units is woven by two said dark coloring yarns while one of said dark coloring yarns is woven to float on said center region as a shading yarn, such that a contrast of light and shade is created through said light coloring yarns and said dark coloring yarns to enhance a three dimensional stitching effect of said waffleweave.

2. The three dimensional waffleweave, as recited in claim 1 wherein said light coloring yarns and said dark coloring yarns are longitudinally extending to form a warp portion of each of said waffleweave units and said light coloring yarns and said dark coloring yarns are transversely extending to form a weft portion of each of said waffleweave units, wherein said light coloring yarns of said warp portion are interlaced with said light coloring yarns of said weft portion to form said center region, wherein said dark coloring yarns of said warp portion are interlaced with said dark coloring yarns of said weft portion to form said sidewalls.

3. The three dimensional waffleweave, as recited in claim 2, wherein one of said dark coloring yarns within said warp portion is woven in a floating manner to form said shading yarn of said respective sidewall and one of said dark coloring yarns within said weft portion is woven in a floating manner to form said shading yarn of another said sidewall, wherein said two shading yarns are extended in an end-to-end manner to form a L-shaped shading boundary of said respective waffleweave unit to create said contrast of light and shade with respect to said center region.

4. The three dimensional waffleweave, as recited in claim 3, wherein said warp yarn portion of each of said waffleweave units is formed by six said light coloring yarns and two dark coloring yarns extending longitudinally, wherein one of said two dark coloring yarns is woven to float on said six light coloring yarns as said shading yarn.

5. The three dimensional waffleweave, as recited in claim 3, wherein said weft portion of each of said waffleweave units is formed by four said light color warp and two dark yarns extending transversely, wherein one of said two dark coloring yarns is woven to float on said four light coloring yarns as said shading yarn.

6. The three dimensional waffleweave, as recited in claim 4, wherein said weft portion of each of said waffleweave units is formed by four said light color warp and two dark yarns extending transversely, wherein one of said two dark coloring yarns is woven to float on said four light coloring yarns as said shading yarn.

7. The three dimensional waffleweave, as recited in claim 1, wherein said two shading yarns of said two adjacent sidewalls of each of said waffleweave units are extended in an end-to-end manner to form a L-shaped shading boundary of said respective waffleweave unit to create said contrast of light and shade with respect to said center region.

8. A method of stitching a three dimensional waffleweave, comprising the steps of:

(a) weaving a plurality of light coloring yarns;

(b) weaving a plurality of dark coloring yarns to interlace with said light coloring yarns to form a plurality of waffleweave units, wherein each of said waffleweave units, having an oblong shape, defines four sidewalls and a center region within said four sidewalls, wherein said center region of each of said waffleweave units is woven by said light coloring yarns and each sidewall of each of said waffleweave units is woven by two dark coloring yarns; and (c) weaving one of said dark coloring yarns on said respective sidewall of each of said waffleweave units to float on said center region thereof as a shading yarn, such that a contrast of light and shade is created through said light coloring yarns and said dark coloring yarns to enhance a three dimensional stitching effect of said waffleweave.

9. The method, as recited in claim 8, in the step (b), further comprising the steps of:

(b.1) longitudinally aligning said light coloring yarns and said dark coloring yarns to form a warp portion of each of said waffleweave units;

(b.2) transversely aligning said light coloring yarns and said dark coloring yarns to form a weft portion of each of said waffleweave units;

(b.3) weaving said light coloring yarns of said warp portion to interlace with said light coloring yarns of said weft portion to form said center region; and (b.4) weaving said dark coloring yarns of said warp portion to interlace with said dark coloring yarns of said weft portion to form said sidewalls.

10. The method, as recited in claim 9, in step (c), further comprising the steps of:

(c.1) weaving one of said dark coloring yarns within said warp portion in a floating manner to form said shading yarn of said respective sidewall; and (c.2) weaving one of said dark coloring yarns within said weft portion in a floating manner to form said shading yarn of another said sidewall, wherein said two shading yarns are extended in an end-to-end manner to form a L-shaped shading boundary of said respective waffleweave unit to create said contrast of light and shade with respect to said center region.

11. The method, as recited in claim 9, wherein said warp yarn portion of each of said waffleweave units is formed by six said light coloring yarns and two dark coloring yarns extending longitudinally, wherein one of said two dark coloring yarns is woven to float on said six light coloring yarns as said shading yarn.

12. The method, as recited in claim 10, wherein said warp yarn portion of each of said waffleweave units is formed by six said light coloring yarns and two dark coloring yarns extending longitudinally, wherein one of said two dark coloring yarns is woven to float on said six light coloring yarns as said shading yarn.

13. The method, as recited in claim 9, wherein said weft portion of each of said waffleweave units is formed by four said light color warp and two dark yarns extending transversely, wherein one of said two dark coloring yarns is woven to float on said four light coloring yarns as said shading yarn.

14. The method, as recited in claim 12, wherein said weft portion of each of said waffleweave units is formed by four said light color warp and two dark yarns extending transversely, wherein one of said two dark coloring yarns is woven to float on said four light coloring yarns as said shading yarn.

15. The method, as recited in claim 8, in step (c), wherein said two shading yarns of said two adjacent sidewalls of each of said waffleweave units are extended in an end-to-end manner to form a L-shaped shading boundary of said respective waffleweave unit to create said contrast of light and shade with respect to said center region.

* * * * *